US006732520B1

(12) United States Patent
Sislegård et al.

(10) Patent No.: US 6,732,520 B1
(45) Date of Patent: May 11, 2004

(54) HYDRAULIC SYSTEM FOR A PRESS

(75) Inventors: Lars-Otto Sislegård, Sundsvall (SE); Fredrik Almberg, Sundsvall (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/402,528

(22) PCT Filed: Mar. 31, 1998

(86) PCT No.: PCT/SE98/00589

§ 371 (c)(1),
(2), (4) Date: Oct. 5, 1999

(87) PCT Pub. No.: WO98/45109

PCT Pub. Date: Oct. 15, 1998

(30) Foreign Application Priority Data

Apr. 8, 1997 (SE) ..... 9701289

(51) Int. Cl.[7] ..... F15B 7/10
(52) U.S. Cl. ..... 60/572; 60/419; 100/269.14
(58) Field of Search ..... 60/533, 477, 484, 60/473, 571, 572, 419, 428, 478; 91/508, 519, 533, 510; 100/269.06, 269.14

(56) References Cited

U.S. PATENT DOCUMENTS 2,300,162 A * 10/1942 Maude ..... 91/519
2,615,302 A * 10/1952 Camerota ..... 91/519
3,550,375 A * 12/1970 Norton et al. ..... 60/419
3,805,530 A * 4/1974 Richardson ..... 60/572
4,924,671 A 5/1990 Reinert
5,640,877 A * 6/1997 Danly ..... 100/269.06

OTHER PUBLICATIONS

Patent Abstracts of Japan, vol. 8, No. 35, M–276, abstract of JP 58–192699 A (Iwatani Sangyo K.K.), Nov. 10, 1983.

* cited by examiner

*Primary Examiner*—F. Daniel Lopez
(74) *Attorney, Agent, or Firm*—Lerner, David, Littenberg, Krumholz & Mentlik, LLP

(57) ABSTRACT

Hydraulic systems are disclosed for operating a press comprising a press ram, a press cylinder including a primary side for activating the press ram and press ram return cylinders for returning the press ram, and at least one flow amplifier comprising a piston including a primary side and a secondary side, the primary side of the piston including a large piston area and a secondary side of the piston having a small piston area, the primary side of the piston being connected to the primary side of the press cylinder and the secondary side of the piston being connected to the press ram return cylinder, at least a portion of the hydraulic system comprising the connection between the primary side of the piston and the primary side of the press cylinder is pressurized.

4 Claims, 2 Drawing Sheets

HYDRAULIC SYSTEM FOR A PRESS

FIELD OF THE INVENTION

The present invention relates to a hydraulic system for a press comprising a press ram, at least one main press cylinder with a primary side for producing press thrust and a device for returning the press ram.

BACKGROUND OF THE INVENTION

Hydraulic systems for a press, such as a bale press, presently comprise pumps, valves, at least one cylinder, a press ram and a tank for the hydraulic medium, which is usually oil. The different parts are connected by hoses and pipes to bring about the desired function.

The tank is usually located above a main press cylinder, which in turn is attached to the press ram. To the press ram is also attached a device for returning the press ram. The returning device can, for example, be at least one separate return cylinder alternatively located in the main press cylinder, which in this manner is double-acting.

The oil thus flows from the tank through at least one valve, for rapid filling, into the primary side of the main press cylinder, while the press ram is lowered to the object to be pressed, for example a pulp bale.

The press ram produces a gradually increasing pressure against the object. In order to create a final press thrust, oil is pumped from the tank into the primary side of the main press cylinder.

When the press ram returns, the oil is pressed from the primary side of the main press cylinder back to the tank.

When the oil is pressurized, air can be dissolved in the oil. When the pressure decreases, the air is thus released. The air in the oil has a negative effect on the hydraulic system. In order to provide for the air to possibly diffuse out of the oil, there is a large volume of oil in the tank. The oil volume in the tank is usually dimensioned to three times the pump flow per minute. The large oil volume should thus be sufficient to provide the oil with such a stay-time and a surface exposed to the atmosphere, such that air can diffuse out of the oil.

Another object of the tank is to take up variations in the oil level during movements of the press ram.

In order to obtain a pressure balance in the tank at rapid level variations, the tank is connected to the atmosphere through a filter. Large air volumes pass through the filters. The filter is close-meshed, in order to prevent particles from the air from following along into the tank, and thus contaminate the oil. The filter must thus have a high flow capacity, because pressure variations in the tank shall not be permitted when the oil level rapidly changes.

The present state of art has a problem in that hydrolysis causes decomposition of seals therein. The air passing through the air filter carries with it moisture which is absorbed by the oil. This moisture causes hydrolysis damage to the seals.

Although the tank is large and contains a considerable amount of oil, there is always a certain amount of air in the oil. Therefore, cavitation problems can arise, for example in pumps and cylinders.

Another problem is, that the oil is disintegrated by oxidation. The oxygen oxidizing the oil originates both from the moisture and from the air in the oil.

The air filter as such also causes problems. Since it must be close-meshed, it becomes readily clogged.

The large tank, which must be located above the main press cylinder so that the oil can flow into the primary side thereof, implies an elevated structure.

SUMMARY OF THE INVENTION

In accordance with the present invention, these and other problems have now been solved by the invention of a hydraulic system for operating a press comprising a press ram, a press cylinder including a primary side for activating the press ram and press ram return means for returning the press ram, and at least one flow amplifier comprising a piston including a primary side and a secondary side, the primary side of the piston having a large active piston area and the secondary side of the piston having a small active piston area, the primary side of the piston being connected to the primary side of the press cylinder and the secondary side of the piston being connected to the press ram return means. A portion of the hydraulic system comprising the connection between the primary side of the piston and the primary side of the press cylinder is pressurized. Preferably, substantially the entire hydraulic system is pressurized.

In accordance with one embodiment of the hydraulic system of the present invention, the press ram return means includes a first total stroke volume and the secondary side of the piston includes a second total stroke volume, the first total stroke volume being greater than the second total stroke volume.

In accordance with another embodiment of the hydraulic system of the present invention, the system includes a pump connected to the secondary side of the piston for maintaining pressure therein.

In accordance with another embodiment of the hydraulic system of the presnt invention, the system includes at least one trap for separating water and air from a hydraulic medium used in the hydraulic system.

According to the present invention, the above problems are solved by providing a flow amplifier operating in counterphase to the main press cylinder in the hydraulic system.

In view of the provision of such a flow amplifier the tank, which according to known techniques is located above the main press cylinder, can now be eliminated.

During lowering of the press ram, the oil is pressed out of the device for returning the press ram, such as the return cylinders, to the flow amplifier, which presses the oil into the primary side of the main press cylinder. The dead weight of the press ram can thus be utilized for amplifying filling on the secondary side of the main press cylinder, which is not possible in accordance with the known state of art.

By use of such a flow amplifier, rapid variations in the oil level, for example in a tank, are avoided. These rapid level variations can cause moisture, air and particles from the air to get into the oil.

At least the part of the hydraulic system between the flow amplifier and the primary side of the main press cylinder is pressurized. Since the supply of the oil to the primary side of the main press cylinder thereby takes place under pressure, a higher flow rate and smaller valve size can now be achieved as compared to that in the prior art.

According to one embodiment of the present invention, substantially the entire hydraulic system is pressurized. Necessary pumps are also supplied from the closed part of the hydraulic system. As a result, only a small tank is required to compensate for heat expansion and oil leakage. The total amount of oil in the system can now also be reduced to, for example, about one-third of the oil volume required in known systems.

Furthermore, if the pumps are fed from the closed part of the hydraulic system, the oil can be de-aired and de-humidified, while substantially no new air and moisture is supplied to the oil.

BRIEF DESCRIPTION OF THE DRAWINGS

The invention may be more readily appreciated with reference to the following detailed description, which in turn refers to the Figures in which.

DETAILED DESCRIPTION

Figure 1:
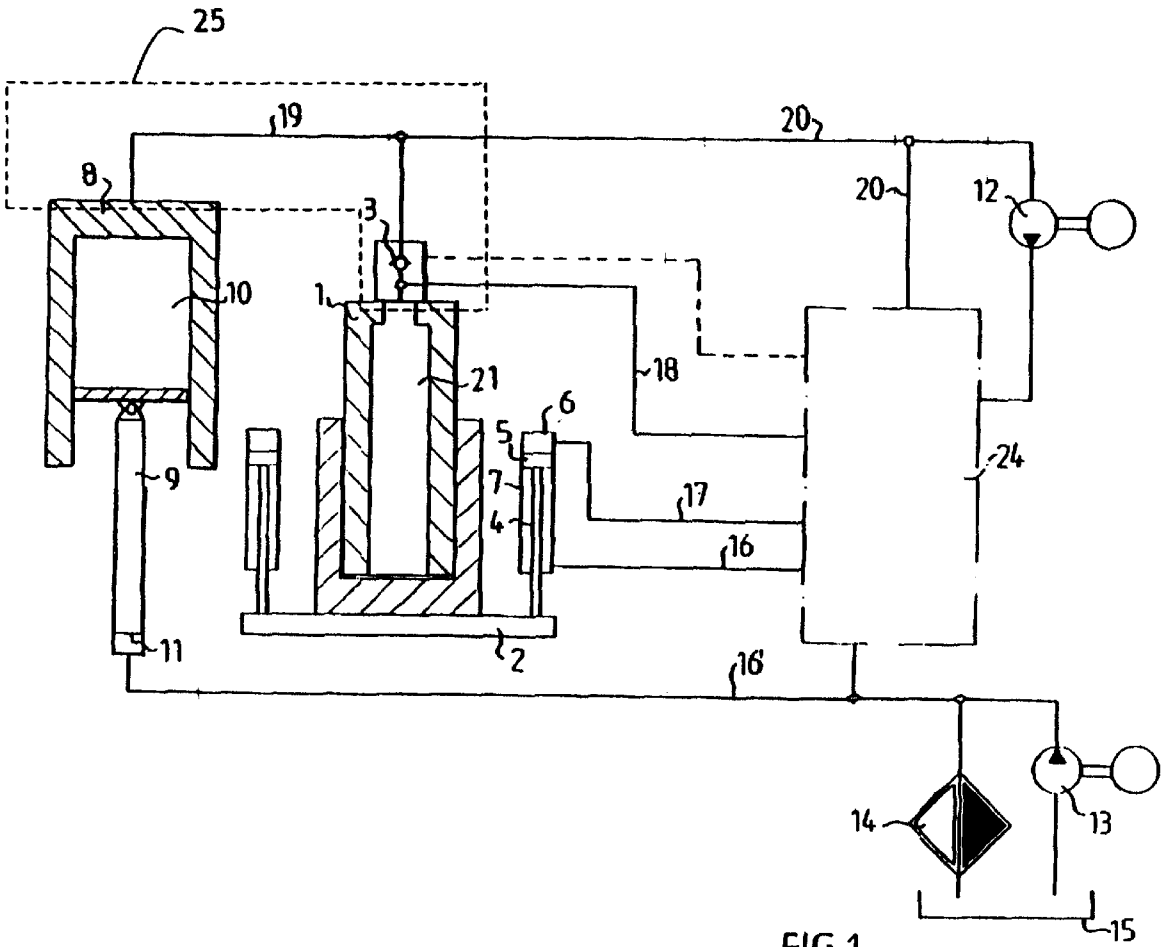
FIG. 1 is schematic representation of one embodiment of the hydraulic system of the present invention used for pulp bale presses.

Tuning first to FIG. 1, the figure shows a hydraulic system for a press comprising a main press cylinder 1 with a primary side 21, a press ram 2, a valve 3 and a device for returning the press ram, where the return device is located in at least one separate return cylinder 4. The return cylinders each comprise a double-acting piston 5 with a large active piston area acting on the primary side 6 of the return cylinders and a small active piston area acting on the secondary side 7 of the return cylinders. The hydraulic system further comprises a flow amplifier 8 with a piston arrangement 9, for example a double-acting piston, or two connected pistons, comprising a large active piston area acting on the primary side 10 of the flow amplifier and a small piston area acting on the secondary side 11 of the flow amplifier. The large piston area should be at least 10 times, and preferably from about 20 to 30 times, larger than the small piston area. A main pump 12 for pumping hydraulic medium, preferably oil, at least one pump 13 for maintaining an overpressure, for the return of oil and for replacing possible leaked oil, and a water and air trap 14 working toward an atmospheric tank 15 are provided, in addition to lines 16, 17, 18, 19 and 20, which connect the various components directly or by means of a valve plate 24. Thus, the valve plate 24 can connect any one of these lines to any of the other lines, as appropriate according to the operation of the press.

Figure 2:
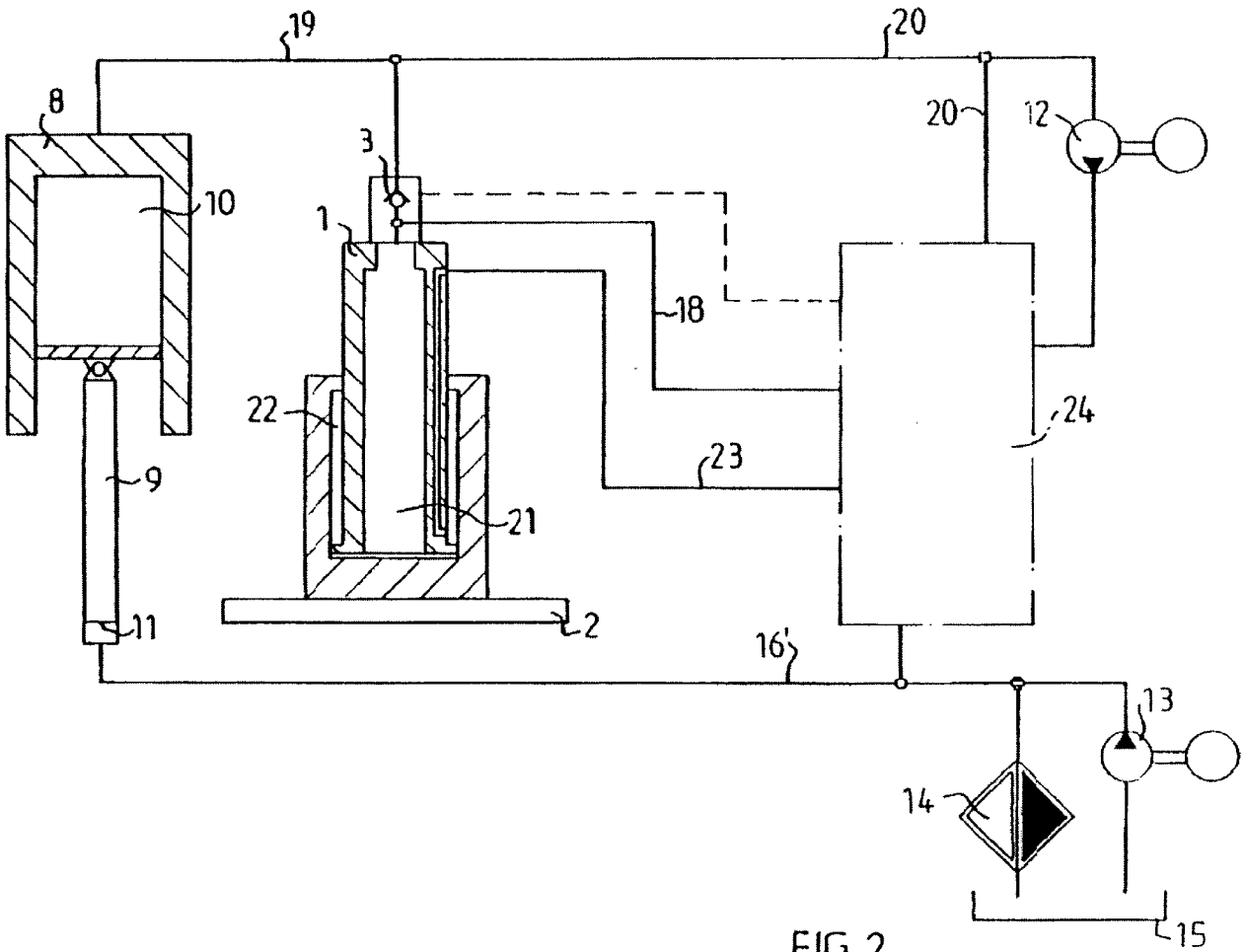
FIG. 2 is a schematic representation of another embodiment of a hydraulic system of the present invention used for pulp bale presses.

FIG. 2 shows a hydraulic system for a press in which, contrary to the embodiment shown in FIG. 1, the return device is located in the main press cylinder 1, which is double-acting and comprises a large active piston area acting on the primary side 21 and a small active piston area acting on the secondary side 22. There is also a line 23, which through the valve plate 24 and line 16 connects the secondary side 22 of the main press cylinder with the secondary side 11 of the flow amplifier. Thus, line 23 is connected to line 16 via the valve plate 24.

The press ram 2 in the hydraulic system according to FIG. 1 is lowered to the object to be pressed, for example a pulp bale, by means of the hydraulic medium through line 17 being pumped into the primary side 6 of the return cylinders, while the hydraulic medium through line 16, valve plate 24 and line 16', by means of the force transferred by the pistons 5 of the return cylinders being pressed into the secondary side 11 of the flow amplifier. The press ram 2 contributes to this force by its dead weight. Thus, when lowering the press ram 2, the valve plate 24 connects line 16 to line 16'.

The force acting on the secondary side 11 of the flow amplifier is transferred by means of the piston arrangement 9 of the flow amplifier to the primary side 10. The hydraulic medium is pressed through line 19 and valve 3 from the primary side 10 of the flow amplifier into the primary side 21 of the main press cylinder.

In order to ensure that the primary side 21 of the main press cylinder will not be without hydraulic medium, the total stroke volume of the return cylinders on the secondary side 7 shall be greater than the stroke volume of the flow amplifier on the secondary side 11.

When the return cylinders 4 can no longer lower the press ram 2 toward the pulp bale, i.e. when a predetermined maximum pressure in the primary side 6 of the return cylinders has been achieved, the valve 3 is closed and the hydraulic medium is pumped into the primary side 21 of the main press cylinder through line 18, while at the same time the hydraulic medium continues to be pumped into the primary side 6 of the return cylinders through line 17.

When the press ram 2 is to be lifted, the hydraulic medium is pumped through line 16 into the secondary side 7 of the return cylinder. The oil in the primary side 6 of the return cylinders is thus pressed by the pistons 5 of the return cylinders through the line 17, valve plate 24 and lines 20 and 19 to the primary side 10 of the flow amplifier. Thus, line 17 is connected to line 20 via the valve plate.

The hydraulic medium in the primary side 21 of the main press cylinder is pressed, while the press ram 2 is being lifted, by means of the valve 3 and line 19 to the primary side 10 of the flow amplifier.

When the press ram 2 in the hydraulic system according to FIG. 2 is lowered to the object to be pressed, for example a pulp bale, the dead weight of the press ram, by means of the force transferred by the small piston areas of the hydraulic cylinder, gives rise to a pressure on the secondary side 22 of the main press cylinder. The hydraulic medium in the secondary side of the main press cylinder is thus pressed through line 23, valve plate 24 and line 16 into the secondary side 11 of the flow amplifier. Thus, line 23 is connected to line 16 via the valve plate 24.

The force acting on the secondary side 11 of the flow amplifier is transferred by the piston arrangement 9 of the flow amplifier to the primary side 10. The hydraulic medium is pressed through line 19 and valve 3 from the primary side 10 of the flow amplifier into the primary side 21 of the main press cylinder.

In order to ensure that the primary side 21 of the main press cylinder will not be without hydraulic medium, the stroke volume of the main press cylinder on the secondary side 22 shall be greater than the stroke volume of the flow amplifier on the secondary side 11.

When the dead weight of the press ram can no longer lower the press ram 2 toward the pulp bale, i.e. when a predetermined maximum pressure has been achieved in the secondary side 22 of the main press cylinder, the valve 3 is closed, and the hydraulic medium is pumped into the primary side 21 of the main press cylinder through line 18.

When the press ram 2 is to be lifted, the hydraulic medium is pumped through line 23 into the secondary side 22 of the main press cylinder.

The hydraulic medium in the primary side 21 of the main press cylinder is pressed, while the press ram 2 is being lifted, by means of the valve 3 and line 19 to the primary side 10 of the flow amplifier.

In both of the embodiments shown in FIGS. 1 and 2, in order to ensure that substantially no moisture and air be found in the hydraulic medium, part of the hydraulic medium is led through the water and air trap 14 for separating air and water.

If the water and air trap 14 works against atmospheric pressure, the trap 14 is connected to the atmospheric tank 15, from which pump 13 pumps the hydraulic medium, which is substantially free of water and air, to the hydraulic system.

In connection with the embodiments of the present invention as shown herein, substantially the entire hydraulic system is pressurized.

In one embodiment of the present invention, only the part 25 of the hydraulic system between the flow amplifier 8 and main press cylinder primary side 21 is pressurized.

The required pumps in this embodiment are fed from an atmospheric tank.

For maintaining the pressure in the closed part of the system, the pump 13 is connected to the secondary side 11 of the flow amplifier.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A hydraulic system for operating a press comprising:

a press ram;

a press cylinder including a primary side for activating said press ram and press ram return means for returning said press ram;

at least one flow amplifier comprising a piston including a primary side and a secondary side, said primary side of said piston having a large active piston area and said secondary side of said piston having a small active piston area, said primary side of said piston being connected to said primary side of said press cylinder and said secondary side of said piston being connected to said press ram return means, wherein said connection between said primary side of said piston and said primary side of said press cylinder is pressurized; and a pump connected to said secondary side of said piston for maintaining pressure therein.

2. The hydraulic system of claim 1 wherein substantially said entire hydraulic system is pressurized.

3. The hydraulic system of claim 1 wherein said press ram return means includes a first total stroke volume and said secondary side of said piston includes a second total stroke volume, said first total stroke volume being greater than said second total stroke volume.

4. The hydraulic system of claim 1 including at least one trap for separating water and air from a hydraulic medium used in said hydraulic system.

* * * * *